US009478338B2

(12) United States Patent
Chen et al.

(10) Patent No.: US 9,478,338 B2
(45) Date of Patent: Oct. 25, 2016

(54) ACTUATOR DRIVER CIRCUIT

(71) Applicant: EATON CORPORATION, Cleveland, OH (US)

(72) Inventors: Qizhou Chen, Shanghai (CN); Tianyu Chen, Jingzhou (CN); Li Yu, Shanghai (CN); Yilun Chen, Shanghai (CN); Jack Gu, Shanghai (CN)

(73) Assignee: EATON CORPORATION, Cleveland, OH (US)

( * ) Notice: Subject to any disclaimer, the term of this patent is extended or adjusted under 35 U.S.C. 154(b) by 133 days.

(21) Appl. No.: 14/558,902

(22) Filed: Dec. 3, 2014

(65) Prior Publication Data

US 2016/0163441 A1 Jun. 9, 2016

(51) Int. Cl.
*H01F 7/08* (2006.01)
*H01F 7/06* (2006.01)

(52) U.S. Cl.
CPC ..... *H01F 7/064* (2013.01); *H01F 7/081* (2013.01)

(58) Field of Classification Search
CPC ..... H01F 7/064; H01F 7/081; H01H 47/226
USPC ..... 361/190, 191
See application file for complete search history.

(56) References Cited

U.S. PATENT DOCUMENTS 4,418,374 A * 11/1983 Callan ..... H02H 3/243 361/167
5,532,526 A * 7/1996 Ricco ..... F02D 41/20 123/490
5,936,827 A * 8/1999 Dressler ..... F02D 41/20 361/154
6,900,973 B2 * 5/2005 Tojo ..... F02D 41/20 361/139
7,057,870 B2 * 6/2006 Meyer ..... F02D 41/20 361/139
8,004,810 B2 * 8/2011 Shuey ..... H02H 1/0007 361/111
2012/0292998 A1 * 11/2012 Nagayasu ..... H01H 33/38 307/43
2015/0022933 A1 * 1/2015 Parga-Cacheiro .... H01F 7/1811 361/190

FOREIGN PATENT DOCUMENTS

CN 202917401 5/2013

* cited by examiner

*Primary Examiner* — Scott Bauer
(74) *Attorney, Agent, or Firm* — Eckert Seamans Cherin & Mellott, LLC; Nathaniel C. Wilks; Grant E. Coffield

(57) ABSTRACT

A circuit for driving an actuator including a closing coil and an opening coil, the circuit including a first electrical switch, a second electrical switch, a third electrical switch, a first diode, a second diode, a third diode, and a capacitor electrically connected to a second terminal of the third electrical switch. The circuit is structured such that controlling the state of the first, second, and third transistors causes current flowing through the circuit to flow through one of the closing coil and the opening coil and to not flow through the other of the closing coil and the opening coil.

18 Claims, 4 Drawing Sheets

ACTUATOR DRIVER CIRCUIT

BACKGROUND

1. Field

The disclosed concept relates generally to circuits, and in particular, to circuits for driving actuators.

2. Background Information

Magnetic actuators, such as those used in circuit breakers, have an underlying circuitry in order to drive it. Some types of actuators are bi-stable, meaning that they will remain in their current state when power is removed. Bi-stable actuators generally have a closing coil and an opening coil. Current passing through the closing coil will cause the actuator to move to a closed state and current passing through the opening coil will cause the actuator to move to the open state.

FIG. 1 shows an example of one type of circuit used for driving a bi-stable actuator having a closing coil 1 and an opening coil 2. The closing coil 1 and the opening coil 2 are depicted in the circuit diagram shown in FIG. 1. The circuit of FIG. 1 includes three transistors. Applying control signals to the gates of the transistors controls whether current flows through the closing coil 1 or the opening coil 2. In addition to the three transistors, the circuit of FIG. 1 further includes six diodes and a power resistor.

FIG. 2 shows an example of a second type of circuit used for driving a bi-stable actuator having a closing coil 1 and an opening coil 2. The circuit shown in FIG. 2 is similar to the circuit disclosed in Chinese Patent No. 202917401. The circuit of FIG. 2 includes four transformers. Applying control signals to the gates of the transistors controls whether current flows through the closing coil 1 or the opening coil 2. In addition to the four transistors, the circuit of FIG. 2 further includes four diodes and a capacitor.

Although the circuits of FIGS. 1 and 2 can be used to drive a bi-stable actuator, it would be desirable to reduce the number of circuit components used to drive a bi-stable actuator, as each circuit component adds to cost. There is room for improvement in circuits for driving bi-stable actuators.

SUMMARY

These needs and others are met by embodiments of the disclosed concept in which a circuit for driving an actuator including a closing coil and an opening coil is controllable to different states in which current flows through the closing coil or the opening coil.

In accordance with one aspect of the disclosed concept, a circuit for driving an actuator including a closing coil having a first end and a second end and an opening coil having a first end and a second end, the circuit comprising: a first electrical switch having a first terminal electrically connected to the second end of the closing coil; a second electrical switch having a first terminal electrically connected to the second end opening cold; a third electrical switch having a first terminal electrically connected to the first ends of the closing and opening coils; a first diode having an anode electrically connected to the second end of the closing coil; a second diode having an anode electrically connected to the second end of the opening coil; a third diode electrically connected to the first ends of the closing and opening coils; and a capacitor electrically connected to a second terminal of the third electrical switch, wherein the circuit is structured such that controlling the state of the first, second, and third electrical switches causes current flowing through the circuit to flow through one of the closing coil and the opening coil and to not flow through the other of the closing coil and the opening coil.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
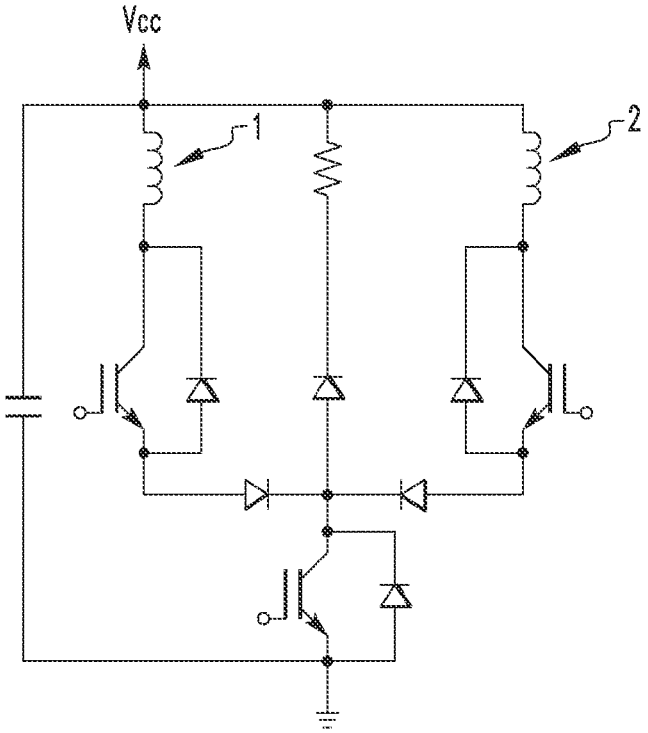
FIG.1 (PRIOR ART)
FIG. 1 is a circuit diagram of a prior circuit for driving a bi-stable actuator.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

Figure 3A:
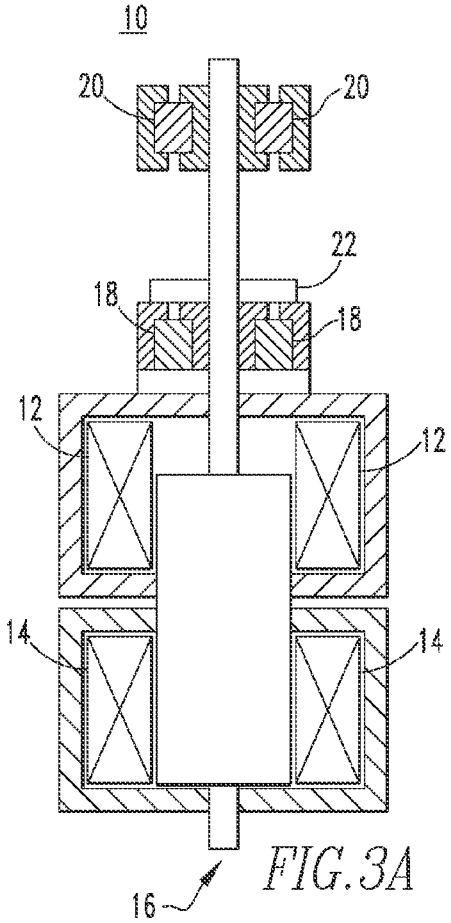
FIG. 3A is a schematic diagram of a bistable actuator with an armature in a first position in accordance with an embodiment of the disclosed concept.
Figure 3B:
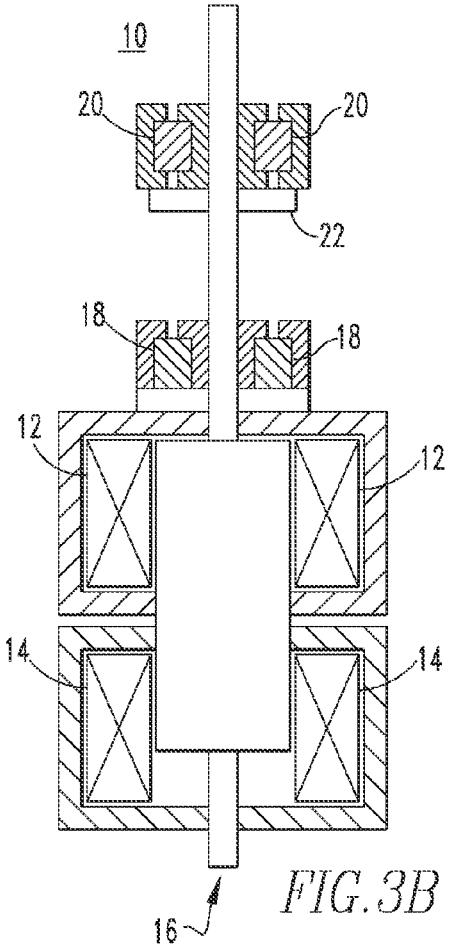
FIG. 3B is a schematic diagram of the bi-stable actuator of FIG. 3A with the armature in a second position.

FIGS. 3A and 3B are cross-sectional views of a bi-stable magnetic actuator 10 in accordance with embodiments of the disclosed concept. The bi-stable magnetic actuator 10 includes a closing coil 12, an opening coil 14, an armature 16, and first and second permanent magnets 18,20.

The armature 16 is structured to move between a first position, as shown in FIG. 3A, and a second position, as shown in FIG. 3B. The armature 16 includes a stopper member 22 which is disposed between the first and second permanent magnets 18,20. When the armature 16 is in the first position, as shown in FIG. 3A, the stopper member 18 is disposed in the vicinity of the first permanent magnet 18. In the first position, magnetic fierce from the first permanent magnet 18 acts on the stopper member 22 to maintain the armature 16 in the first position. When the armature 16 is in the second position, as shown in FIG. 3B, the stopper member 22 is located in the vicinity of the second permanent magnet 20. In the second position, magnetic force from the second permanent magnet 20 acts on the stopper member 22 to maintain the armature 16 in the second position.

Movement of the armature 16 from the first position to the second position is accomplished by passing current through the closing coil 12. In more detail, when sufficient current is passed through the closing coil 12 magnetic forces on the armature 16 from the closing coil overcome the magnetic forces from the first permanent magnet 16 holding the armature 16 in the first position, which allows the armature 16 to move to the second position, as shown in FIG. 3B. Similarly, to move the armature 16 from the second position to the first position, current is passed through the opening coil 14.

Although FIGS. 3A and 3B depict one example a bi-stable magnetic actuator 10, it is contemplated that other types of bi-stable actuators may be employed in conjunction with the disclosed concept without departing from the scope of the disclosed concept. Furthermore, it is contemplated that any other type of actuator that employs a closing coil and an opening coil may be employed in conjunction with the disclosed concept without departing from the scope of the disclosed concept.

Figure 4:
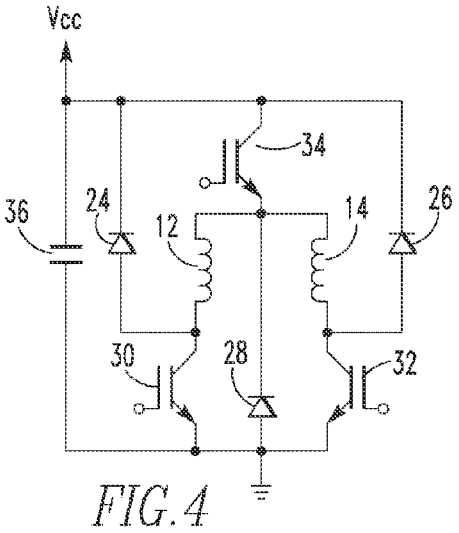
FIG. 4 is a circuit diagram of a circuit for driving an actuator in accordance with an example embodiment of the disclosed concept.

Referring to FIG. 4, a circuit diagram of a circuit for driving a bi-stable actuator in accordance with an example embodiment of the disclosed concept is shown. It is contemplated that the circuit of FIG. 4 may be employed to drive the bi-stable actuator of FIGS. 3A and 3B. The circuit of FIG. 4 includes the closing coil 12, the opening coil 14, first, second and third diodes 24,26,28, first, second, and third transistors 30,32,34, and a capacitor 36.

As shown in the circuit diagram of FIG. 4, a first end of the capacitor 36, cathodes of the first and second diodes 24,26, and a collector of the third transistor 34 are electrically connected together. The emitter of the third transistor 34 is electrically connected to first ends of the closing and opening coils 12,14 and the cathode of the third diode 28. The second end of the closing coil 12 is electrically connected to the anode of the first diode 24 and the collector of the first transistor 30. The second end of the opening coil 14 is electrically connected to the anode of the second diode 26 and the collector of the second transistor 32. Emitters of the second and third transistors 30,32 are electrically connected to the second end of the capacitor 36 and ground.

Gates of the first, second, and third transistors 30,32,34 receive control signals to from control circuitry (not shown) to control their states. In a closed state, current is able to flow between the collector and emitter. In an open state, current is not able to flow between the collector and emitter.

The current flowing through the closing coil 12 and opening coil 14 can be controlled by controlling the states of the first, second, and third transistors 30,32,34. The circuit has four states: charging the closing coil 12; discharging the closing coil 12; charging the opening coil 14; and discharging the opening coil 14.

Figure 5A:
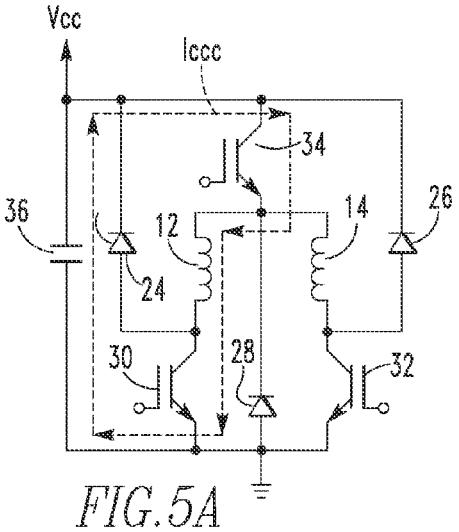
FIG. 5A is a circuit diagram of the circuit of FIG. 4 in the charging closing coil state.

In the charging the closing coil 12 state, the first and third transistors 30,34 are closed and the second transistor 32 is open. In this state, current flows through the circuit along current path $I_{CCC}$ as shown in FIG. 5A. In this state, current flows out of the emitter of the second transistor 34 and through the closing coil 12. The current then flows through the first transistor 30 and the capacitor 36 back to the second transistor 34.

Figure 5B:
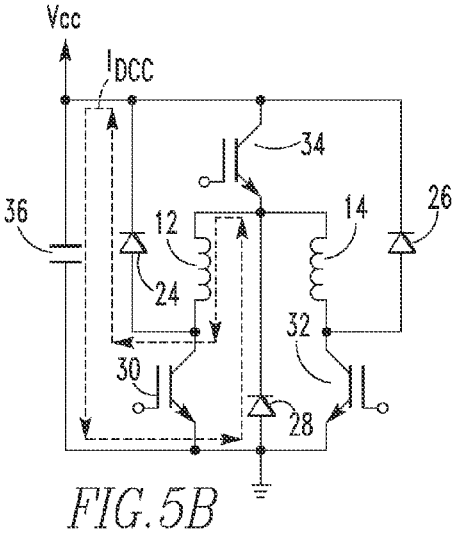
FIG. 5B is a circuit diagram of the circuit of FIG. 4 in the discharging closing coil state.

In the discharging the closing coil state, the first, second, and third transistors 30,32,34 are all open. In this state, current flows through the circuit along current path $I_{DCC}$, as shown in FIG. 5B. In this state, current flows in the opposite direction through the capacitor 36, from its first end to its second end. The current then flows through the third diode 28, through the closing coil 12, then through the first diode 24 to get back to the first end of the capacitor 36.

Figure 5C:
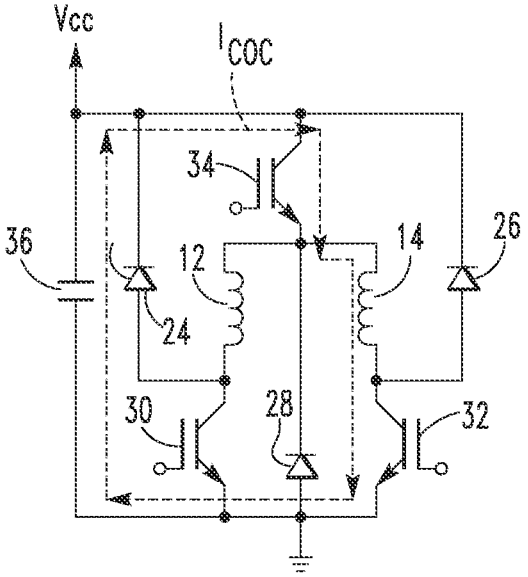
FIG. 5C is a circuit diagram of the circuit of FIG. 4 in the charging opening coil state.

In the charging the opening coil state, the second and third transistors 34,36 are closed and the first transistor 30 is open. In this state, current flows through the circuit along current path $I_{COC}$, as shown in FIG. 5C. In this state, current flows out of the emitter of the third transistor 34 and through the opening coil 14. The current then flows through the second transistor 32 and the capacitor 36 to return to the third transistor 34.

Figure 5D:
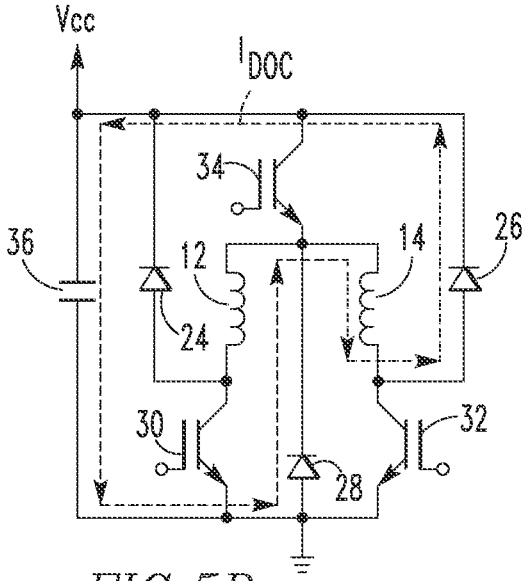
FIG. 5D is a circuit diagram of the circuit of FIG. 4 in the discharging opening coil state.

In the discharging the opening coil state, the first, second, and third transistors 30,32,3.4 are all open. In this state, current flows through the circuit along current path $I_{DOC}$, as shown in FIG. 5D. In this state, current flows through the capacitor 36 in the opposite direction, from the first end to the second end. The current then flows through the third diode 28, through the opening coil 14, then through the second diode 26 to get back to the first end of the capacitor 36.

Although the discharging the closing coil 12 and discharging the opening coil 14 share the same configuration of transistor states, these circuit states differ in that the discharging the closing coil 12 state immediately follows the charging the closing coil 12 state and the discharging the opening coil 14 state immediately follows the charging the opening coil 14 state. In the charging states, current flows from the capacitor and through the respective coil that is being charged. In the discharging states, current flows from the recently charged coil to the capacitor.

Figure 2:
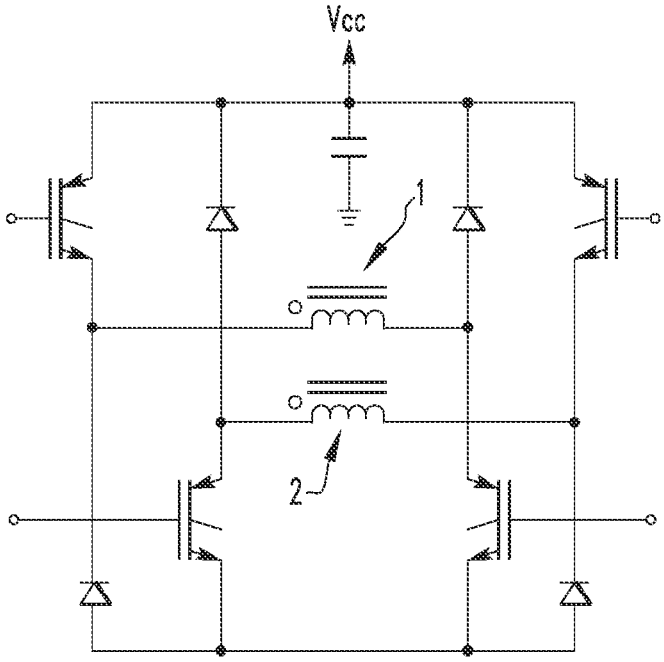
FIG.2 (PRIOR ART)
FIG. 2 is a circuit diagram of another prior circuit for driving a bi-stable actuator.

As shown in FIGS. 5A-D, manipulating the state of the first, second, and third transistors 30,32,34 controls whether current flows through the closing coil 12 or the opening coil 14. In this manner, the armature 16 of a bi-stable magnetic actuator 10 (such as the one shown in FIGS. 3A and 3B) can be controlled to move between first and second positions using the circuit of FIG. 4. Moreover, the circuit of FIG. 4 utilizes fewer components than the circuits of FIGS. 1 and 2, and thus has a reduced cost compared to the circuits of FIGS. 1 and 2.

It is contemplated that any suitable type of transistor may be used as the first, second, and third transistors 30,32,34 in the circuit of FIG. 4 without departing from the scope of the disclosed concept. For example and without limitation, in some example embodiments, the first, second, and third transistors 30,32,34 are insulated-gate bipolar transistors (IGBT). It is also contemplated that types of electrical switches other than transistors may be employed in the circuit of FIG. 4 without departing from the scope of the disclosed concept.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A circuit for driving an actuator including a closing coil having a first end and a second end and an opening coil having a first end and a second end, the circuit comprising:

a first electrical switch having a first terminal electrically connected to the second end of the closing coil;

a second electrical switch having a first terminal electrically connected to the second end of the opening coil;

a third electrical switch having a first terminal electrically connected to the first ends of the closing and opening coils;

a first diode having an anode electrically connected to the second end of the closing coil;

a second diode having an anode electrically connected to the second end of the opening coil;

a third diode electrically connected to the first ends of the closing and opening coils; and a capacitor electrically connected to a second terminal of the third electrical switch, wherein the circuit is structured such that controlling the state of the first, second, and third electrical switches causes current flowing through the circuit to flow through one of the closing coil and the opening coil and to not flow through the other of the closing coil and the opening coil.

2. The circuit of claim 1, wherein when the first and third electrical switches are on and the second electrical switch is off, the circuit is in a charging closing coil state in which current flows through the closing coil and does not flow through the opening coil.

3. The circuit of claim 2, wherein in the charging closing coil state current flows through the first electrical switch, the third electrical switch, and the capacitor, and current does not flow through the second transistor or the first, second, and third diodes.

4. The circuit of claim 2, wherein when the first, second, and third electrical switches are off immediately following the charging closing coil state, the circuit is in a discharging closing coil state in which current flows through the closing coil and does not flow through the opening coil.

5. The circuit of claim 4, wherein in the discharging closing coil state, current flows through the first and third diodes and the capacitor, and current does not flow through the first, second, and third electrical switches or the second diode.

6. The circuit of claim 1, wherein when the second and third electrical switches are on and the first electrical switch is off, the circuit is in a charging opening coil state in which current flows through the opening coil and does not flow through the closing coil.

7. The circuit of claim 6, wherein in the charging opening coil state, current flows through the second and third electrical switches and the capacitor, and current does not flow through the first electrical switch or the first, second, and third diodes.

8. The circuit of claim 6, wherein the first, second, and third electrical switches are off immediately following the charging the opening coil state, the circuit is in a discharging opening coil state in which current flows through the opening coil and does not flow through the closing coil.

9. The circuit of claim 8, wherein in the discharging the opening coil state, current flows through capacitor and second and third diodes, and current does not flow through the first, second, and third electrical switches or the first diode.

10. The circuit of claim 1, wherein second terminals of the first and second electrical switches, cathodes of the first and second diodes, and an anode of the third diode are electrically connected to the capacitor.

11. The circuit of claim 1, wherein the electrical switches are transistors.

12. The circuit of claim 1, wherein the electrical switches are insulated-gate bipolar junction transistors.

13. The circuit of claim 1, wherein the first, second, and third electrical switches are structured to receive control signals from control circuitry to control states of the first, second, and third electrical switches.

14. The circuit of claim 1, wherein the actuator is a bi-stable actuator.

15. The circuit of claim 1, wherein the actuator includes an armature structured to move between a first position and a second position.

16. The circuit of claim 15, wherein current flowing through one of the closing coil and opening coil causes the armature to move from the first position to the second position; and wherein current flowing through the other of the closing coil and the opening coil causes the armature to move from the second position to the first position.

17. The circuit of claim 15, wherein the actuator further includes a first permanent magnet and a second permanent magnet; and wherein the armature includes a stopper member disposed between the first permanent magnet and the second permanent magnet.

18. The circuit of claim 17, wherein when the armature is in the first position, the stopper member is disposed in the vicinity of the first permanent magnet and magnetic force from the first permanent magnet acts on the stopper member to maintain the armature in the first position; and wherein when the armature is in the second position, the stopper member is disposed in the vicinity of the second permanent magnet and magnetic force from the second permanent magnet acts on the stopper member to maintain the armature in the second position.

* * * * *